US005239719A

United States Patent [19]

Ware

[11] Patent Number: 5,239,719

[45] Date of Patent: Aug. 31, 1993

[54] METHOD AND APPARATUS FOR DETECTING ABNORMAL MOVEMENT OF PIECE GOODS IN DYEING AND FINISHING MACHINES

[75] Inventor: Melvin L. Ware, Blacksburg, S.C.

[73] Assignee: Gaston County Dyeing Machine Co., Stanley, N.C.

[21] Appl. No.: 934,127

[22] Filed: Aug. 21, 1992

[51] Int. Cl.[5] ..... D06B 3/28; D06B 23/00

[52] U.S. Cl. ..... 8/152; 68/178

[58] Field of Search ..... 8/152; 68/177, 178, 68/12.07

[56] References Cited

U.S. PATENT DOCUMENTS

| | | | |
|---|---|---|---|
| 3,830,084 | 8/1974 | Caputi | 68/178 |
| 4,015,452 | 4/1977 | Kreitz | 68/177 X |
| 4,107,801 | 8/1978 | Tachibana | 8/152 |
| 5,014,526 | 5/1991 | Hacker et al. | 68/178 |

*Primary Examiner*—Philip R. Coe

*Attorney, Agent, or Firm*—Shefte, Pinckney & Sawyer

[57] ABSTRACT

A method and apparatus operable on a jet dyeing or finishing machine having a treatment chamber, a lifter reel, and a jet nozzle for movement of a fabric rope through the chamber for wet treatment thereof. Such an apparatus includes a direct current motor for driving the lifter reel, a mechanism for periodically deactivating the lifter reel drive, a sensing component for sensing the electromotive force (EMF) generated by the direct current lifter reel motor during periods of deactivation, and appropriate circuitry for comparing the sensed EMF value with a predetermined threshold value and signaling an operator in the event that the sensed EMF value is below the predetermined threshold value. A low EMF value is interpreted as an indication that the fabric rope is stopped or moving slowly over the lifter reel, with the lifter reel drive motor correspondingly rotating at a relatively lower rotational velocity, and the assumption is made that the slow rate of travel of the fabric rope is caused by tangling or other disruptions.

21 Claims, 4 Drawing Sheets

METHOD AND APPARATUS FOR DETECTING ABNORMAL MOVEMENT OF PIECE GOODS IN DYEING AND FINISHING MACHINES

BACKGROUND OF THE INVENTION

This invention relates to the treatment of piece goods in a jet dyeing or finishing machine and more particularly, to the detection of abnormal movement of piece goods in a jet dyeing or finishing machine.

Such jet dyeing or finishing machines generally utilize a vessel containing a treating bath of processing liquid, through which a piece of textile material is circulated in endless rope form. The vessel typically contains a treatment chamber containing a bath of treatment liquid through which the textile rope passes in a compact plaited plug form. However, some modern jet dyeing and finishing machines apply the treatment liquid primarily using the jet nozzle, resulting in little or no submerging of the rope plug in any liquid in the treatment chamber. A rope circulating system progressively withdraws the rope from the leading end of the plug and returns it to the trailing end of the plug under the influence of the processing liquid being applied and circulated by a jet assembly through which the rope passes during circulation.

Such machines have presented problems in the wet processing of surface sensitive textile fabrics such as fabrics formed of relatively low twist spun yarns, fabrics formed of loosely knit, stretchable construction, certain plush or pile and other delicate fabrics. Fabrics of these types are especially susceptible to various forms of surface damage and it is not unusual for such machines to produce fabric wrinkling, fuzziness, excessive stretching, and, in pile fabrics, disoriented pile.

In order to alleviate this problem, a number of machines have used a low traction surface for the outer drum of the lifter reel. Typically, such a lifter reel would have no frictional material on its outer surface but may have some dimple-type extrusions thereon. Such a surface cannot provide enough traction to pull the material over the lifter reel against any significant resistance, such as a tangle in the rope coming from the plug. Accordingly, the material may slip against the reel as the reel continues to be driven at a predetermined rate even if the rope slows, or in some instances, stops.

Such treatment vessels are known to induce turbulence into the liquor bath in order to facilitate movement of the rope and improve its contact with the treating liquor baths. Improved plug contact with the treating liquor is also facilitated by having a generally irregularly shaped transfer section in the interior of the tubular tub. However, these characteristics tend to interfere with the path of the fabric rope during treatment and thus restrict the rope's movement. This problem is compounded by the fact that the fabric rope is by nature prone to entanglement as it is plaited into plug form, and as the plug moves through the treatment chamber such entanglement may in some instances result in a resistance opposing the force of the lifter reel and jet sufficient to slow or even stop circulation of the rope. The tangling presents significant problems since slowing or stopping of the material in the treating bath can result in unacceptable treatment results or may damage delicate fabrics at the point of entanglement and both slowing and stopping require operator attention.

Many existing machines detect abnormal rope movement, which could be caused by a tangled fabric rope, using a so-called "trip motor" connected to the lifter reel to detect a certain amperage when the rope of material becomes tangled, inhibiting rotation of the lifter reel and thus increasing the load on the drive motor. A "trip motor" will automatically disengage or shut down upon drawing a predetermined amount of current or "load." However, when treating delicate, smooth fabrics utilizing the aforementioned low traction lifter reel surfaces, even if the fabric rope becomes tangled, the continuously driven lifter reel will still rotate under application of drive power, sliding on the slowed or stopped rope and will not load the motor enough to draw the necessary amperage to trip the motor and signal an alarm condition. Therefore, it would be advantageous if drive of the lifter reel could be interrupted to determine the rope circulation rate. By stopping the lifter reel, a true picture of rope movement could be assimilated, absent the influence of the lifter reel driving movement.

An attempt to detect rope entanglement utilizing a different apparatus is discussed in U.S. Pat. No. 3,830,084 to Caputi which controls the operation of a dyeing or finishing machine using a control apparatus which comprises a pulse generator in the form of a permanent magnet attached to the rope being dyed and a pulse detector device having a number of ferromagnetic cores mounted on an annular collar that is electrically connected to a signaling device. Rope movement causes the permanent magnet to cyclically pass through the annular collar, thereby inducing an electromotive force in the coils formed by the ferromagnetic cores which is transmitted to the signaling device. A pulse is detected each time the rope completes a circuit of its closed loop dyeing path. If the rope stops moving, the expected pulse is not detected, and, in response, an alarm is sounded to signal an operator that rope travel has been reduced below tolerance levels or has ceased altogether. The Caputi apparatus and method, however, requires significant modifications and/or additions to the jet dyeing machine to be monitored and requires the application of a magnet to the rope.

Thus, a simple, inexpensive, and reliable solution to the problem of detecting rope entanglement in jet dyeing machines is needed.

SUMMARY OF THE INVENTION

It is accordingly an object of the present invention to provide a method and apparatus for sensing disruptions in fabric flow in a machine for wet processing of fabric in endless rope form. Specifically, it is an object of the present invention to provide a simple, low cost, reliable method and apparatus for detecting disruptions in fabric flow in a jet dyeing machine and providing an alarm in response to such disruptions.

The method and apparatus of the present invention are adapted for sensing disruptions in fabric flow in a machine for wet processing of fabric in endless rope form having jet means for applying liquid to the fabric rope, the application of liquid by the jet means causing circulation of the fabric rope through the machine, and a driven lifter reel over which the fabric rope travels in advance of the jet means.

According to the present invention, the method for sensing disruptions in fabric flow comprises the steps of circulating the fabric rope, periodically interrupting the drive of the lifter reel and sensing the rotational speed of the lifter reel while drive thereto is interrupted, comparing the rotational speed to a predetermined threshold value and initiating a predetermined activity in response to a detected value of the rotational speed which is less than the predetermined threshold value. The step of sensing the rotational speed of the lifter reel includes generating an electromotive force proportional to the rotational speed of the lifter reel. The step of comparing the rotational speed of the lifter reel to a predetermined threshold value includes comparing the generated electromotive force to a predetermined threshold value. The step of predetermined activity initiating is responsive to a predetermined threshold value of voltage less than the generated electromotive force when the fabric rope is traveling at normal operating speed when driven by the jet means. The method preferably includes the step of discontinuing the drive of the lifter reel upon initiation of the predetermined activity to prevent further driving movement of the fabric rope. It is preferred that upon discontinuing drive of the lifter reel, the lifter reel becomes freely rotatable. It is further preferred that the step of predetermined activity initiating includes initiating the activation of an alarm.

According to a preferred embodiment of the present invention, the apparatus for sensing disruptions in fabric flow includes an arrangement for interrupting the drive of the lifter reel and sensing the rotational speed of the lifter reel while drive thereto is interrupted, an arrangement for comparing the rotational speed to a predetermined threshold value and an arrangement for initiating a predetermined activity responsive to a value of rotational speed which is less than the predetermined threshold value. Preferably, the arrangement for sensing the rotational speed of the lifter reel includes an arrangement for generating an electromotive force proportional to the rotational speed of the lifter reel. The arrangement for comparing the rotational speed of the lifter reel to a predetermined threshold value compares the generated electromotive force to a predetermined threshold value. The initiating means initiates a predetermined activity responsive to a predetermined threshold value of voltage less than the electromotive force generated by the generating arrangement when the fabric rope is traveling at normal operating speed when driven by the jet means. Preferably, the initiating means initiates the activation of an alarm.

It is further preferred that the apparatus for sensing disruptions in fabric flow include an assembly for driving the lifter reel having a driving condition wherein the driving assembly imparts a rotational force to the lifter reel and a non-driving condition wherein the driving assembly imparts n rotational force to the lifter reel thereby allowing the lifter reel to rotate in response to the fabric rope movement. During the non-driving condition the arrangement for sensing the rotational speed of the lifter reel produces an electrical signal responsive to the rotational speed of the lifter reel. Preferably, the driving assembly generates an electromotive force responsive to the rotational speed of the lifter reel. The apparatus preferably includes an arrangement for discontinuing drive of the lifter reel to prevent further driving movement of the fabric rope thereby upon initiation of the predetermined activity. In addition, it is preferred that the lifter reel become freely rotatable upon discontinuing the drive thereof so that the contact of the fabric rope traveling thereacross will cause the lifter reel to rotate. The arrangement for generating the electromotive force and driving the lifter reel is preferably a direct current machine which functions as a generator in response to the fabric rope movement on the lifter reel when the drive of the lifter reel is interrupted.

Alternatively, the arrangement for sensing the rotational speed of the lifter reel may include at least one magnetic element associated with said lifter reel for rotation therewith and a detector assembly adjacent said lifter reel for sensing the passage of at least one magnetic element thereby and generating a electrical signal in response thereto.

Preferably, the arrangement for comparing the rotational speed of the lifter reel to the threshold value, detecting the generated electromotive force, comparing the electromotive force to the threshold value, initiating the predetermined activity and periodically interrupting the drive of the lifter reel are included in an electric circuit.

DETAILED DESCRIPTION OF THE PREFERRED EMBODIMENT

Figure 1:
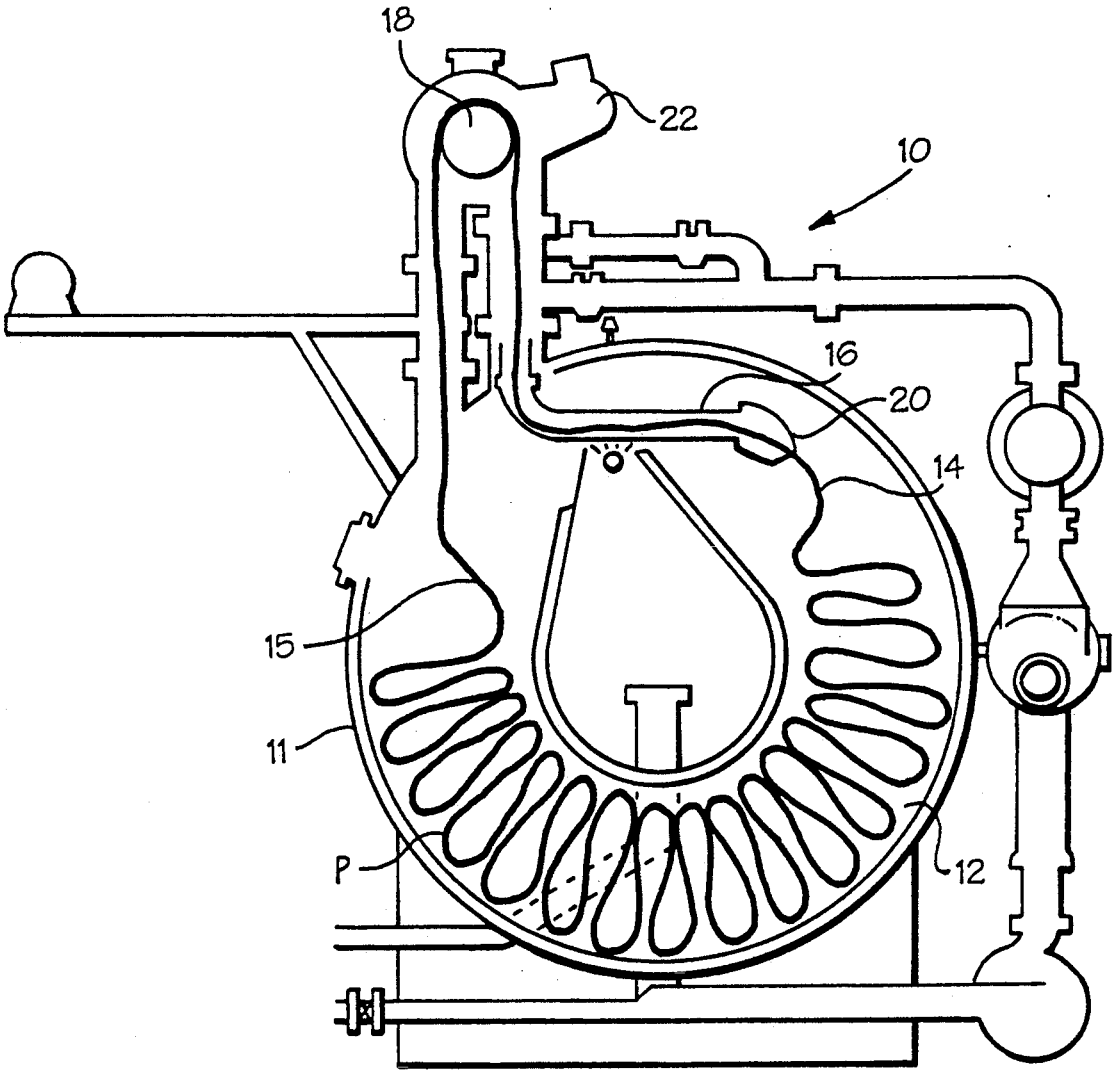
FIG. 1 is a diagrammatic cross-sectional view of a wet processing apparatus having a generally circular treatment chamber and incorporating the preferred embodiment of the apparatus of the present invention.

Referring now to the drawings and particularly to FIG. 1, a textile wet processing apparatus 10 is provided for circulating fabric in an endless rope form. The apparatus 10 includes a generally circular vessel 11 housing a treatment chamber 12 containing a treatment liquor bath through which the fabric rope 14 circulates in a plaited plug form. A jet nozzle assembly 16 receives the fabric rope 14 to be treated from a lifter reel 18 and propels the fabric rope 14 into the treatment chamber 12 from the nozzle 20 providing circulation of the fabric rope 14 through the apparatus 10. As the fabric rope 14 enters the treatment chamber 12 it is plaited into a folded form known as a plug P as seen in FIG. 1. The fabric rope 14 traverses the treatment chamber 12 as a plug P. At the end of the treatment chamber 12, the lifter reel 18 lifts the fabric rope 14 up from the leading end 15 of the plug P in the treatment chamber 12. The lifter reel 18 assists the jet nozzle 20 in propelling the fabric rope 14 and has a low friction surface, yet, as will be seen hereinafter, sufficient friction exists for the fabric engaging the lifter reel to maintain rotation thereof in the absence of lifter reel drive and disruptions in fabric movement. As the fabric rope 14 is drawn from the plug P, it may become entangled, thereby disrupting fabric flow. During periods of normal operation, the lifter reel 18 removes the fabric rope 14 from the plug P and directs the fabric rope 14 to the jet nozzle assembly 16. The pressure of the jet nozzle assembly 16 then pulls the rope 14 from over the lifter reel 18 and propels it back down into the treatment chamber 12. This construction of a jet dyeing machine may be found in Sturkey U.S. Pat. No. 4,318,288 which is herein incorporated by reference. While the apparatus described herein is discussed in relation to the aforementioned jet dyeing machine construction, it is adaptable to most any jet dyeing machine which uses a lifter reel and has a fabric rope circulated therethrough.

Figure 2:
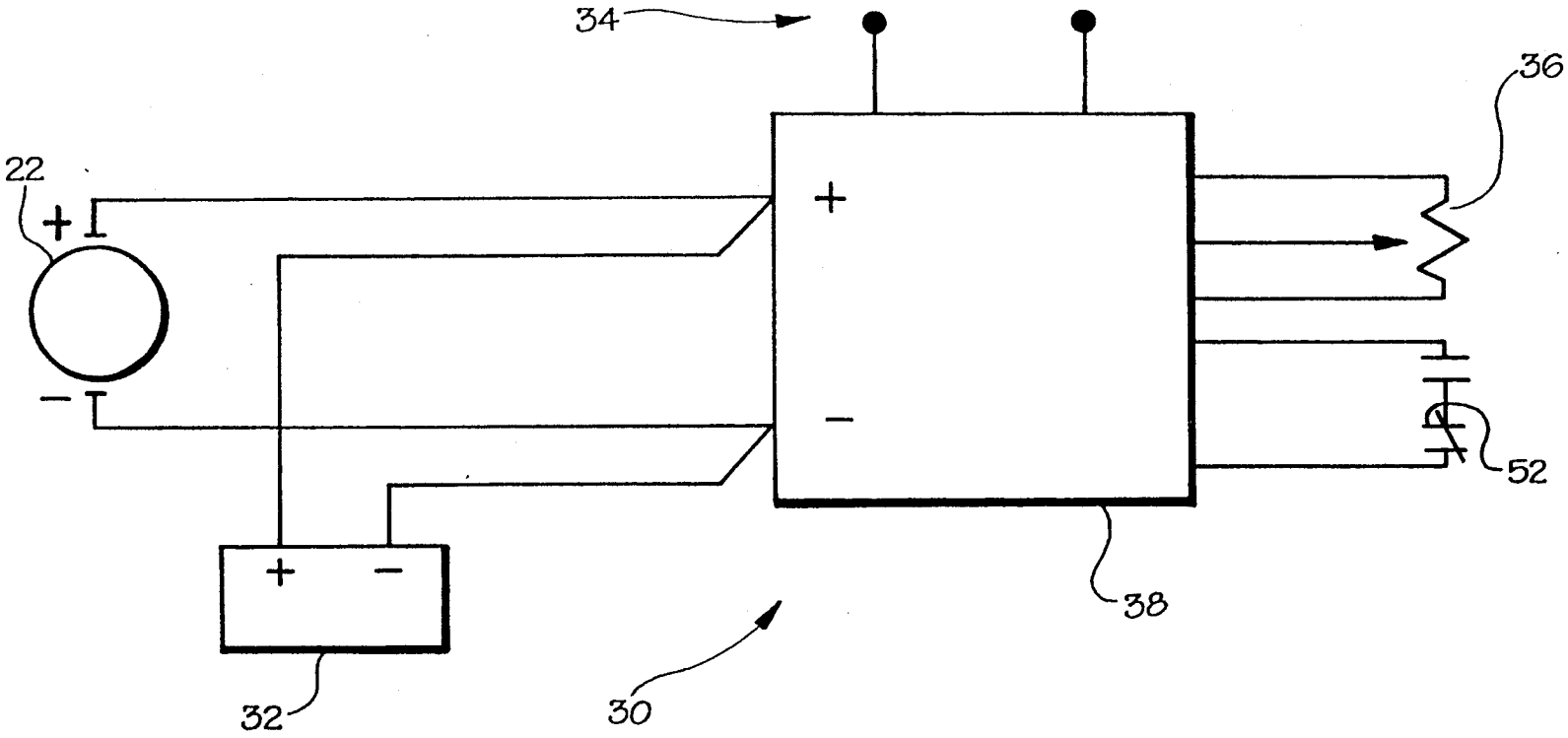
FIG. 2 is a schematic wiring diagram of the electrical control circuitry for the lifter reel drive motor and for sensing obstructions of fabric flow in the wet processing apparatus illustrated in FIG. 1.

The lifter reel 18 is powered by a lifter reel drive motor 22 which is controlled by a conventional DC motor controller 30 (see FIG. 2). The DC motor controller 30 contains a timer controlled mechanism for periodically deactivating the lifter reel drive motor 22 to allow the lifter reel 18 to freely rotate which will be described presently. The periodic deactivation of lifter reel drive is of a sufficiently short duration that, absent obstructions, fabric flow will not be impeded. The lifter reel 18 and the drive motor 22 are also connected to a voltage sensing relay 32 (as shown in FIG. 2) which detects the electromotive force (EMF) generated by the lifter reel drive motor 22 during periods of deactivation. Appropriate circuitry is also included for comparing the detected EMF value with a control or threshold value in order to signal an operator in the event that the detected EMF value is below the control value. An EMF value which is less than the control value is interpreted as an indication that the rope material 14 is stopped or moving slowly over the lifter reel 18, with the reel drive motor 22 correspondingly rotating at a relatively lower rate. The assumption is that the slow rate of travel of the fabric rope 14 is likely caused by tangling of the fabric rope 14. In contrast, an EMF value greater than the control value is interpreted as an indication that the fabric rope 14 is proceeding at normal operating speed over the lifter reel 18, with the reel drive motor 22 correspondingly rotating at a relatively higher rate, and thus it is presumed that the fabric rope 14 is traveling freely through the textile wet processing apparatus 10.

It should be understood that while the preferred embodiment of the present invention is directed to the use of a DC drive motor, the same results may be obtained using an AC drive motor and a separate DC generator driven by the lifter reel. Upon periodic interruption of the AC lifter reel drive, the output of the DC generator would be measured and compared to a predetermined threshold value thus sensing disruptions in fabric flow.

Figure 3:
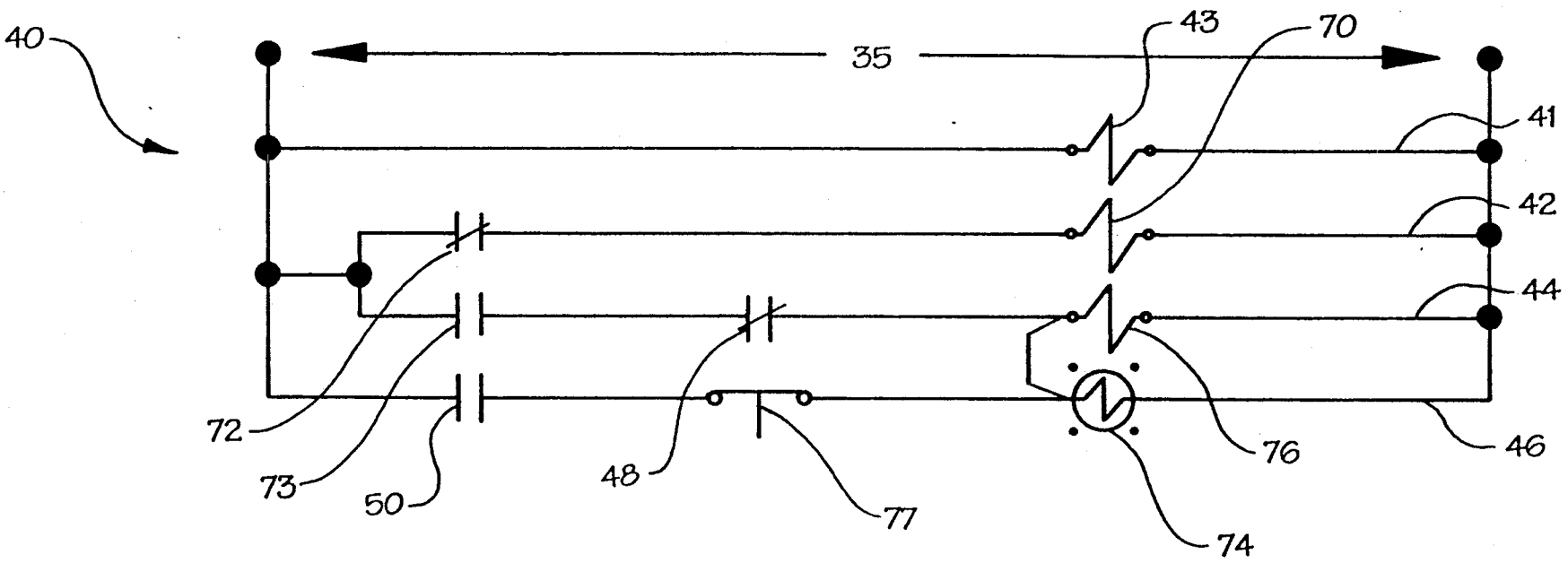
FIG. 3 is a schematic wiring diagram of the relay logic circuit for controlling the drive of the lifter reel and the alarm in the wet processing apparatus illustrated in FIG. 1.

Referring now to FIGS. 2 and 3, schematic diagrams of the electrical control circuitry for the lifter reel drive motor 22, which includes the disruption sensing circuitry and the alarm, are shown. Operating electrical power for the drive motor 22 is supplied to the DC motor controller 38 from a source of alternating current (AC) 34. Within the DC motor control 38, the input AC is converted to direct current (DC) for drive motor 22 operation while AC is applied to the input 35 of the relay logic circuit 40. (See FIG. 3.) Operation of the drive motor 22 is controlled by a control timer 43 which provides a timed duty cycle therefor. It should be understood that a single control timer 43 may control the operation of a plurality of lifter reels within a jet dyeing machine. A timer circuit 41 contains the control timer 43 and is arranged in a parallel configuration with a first control circuit 42 which includes a motor actuating relay 70 and a first timer contact 72. A second control circuit 44 acts in tandem with the voltage sensing relay (VSR) 32 and includes a second timer contact 73, and VSR contacts 48. An alarm circuit 46 includes an alarm condition indicator lamp 74, contacts 50 for the alarm relay 76, and a reset switch 77. The timer circuit 41, the first control circuit 42, the second control circuit 44 and the alarm circuit 46 are all arranged in a parallel configuration. Motor speed is controlled by a separate circuit having a speed control rheostat 36. The relay logic circuit 40 is based on relay logic operation but it should be understood that motor control and the sensing of disrupted fabric flow using the control circuit could just as well be accomplished using a programmable logic controller, microprocessor or a selectively programmed personal computer.

Operation of the circuit is generally as follows. As the fabric rope 14 circulates through the treatment chamber 12, it is propelled therethrough by action of the jet nozzle assembly 16 assisted by the lifter reel 18. During operation, supply voltage 34 is present at the DC motor control circuit 38 and the drive motor 22 is set to the desired speed using the control rheostat 36. Control voltage 34 is simultaneously applied to the relay logic circuit 40 and the control timer 43 is thereby activated. The control timer 43 is a conventional dual cyclical timer having an on-time cycle duration in minutes and an off-time cycle duration in seconds, and includes a timer relay having first contacts 72 and second contacts 73. During the on-time portion of the cycle, the lifter reel drive motor 22 is activated and correspondingly, during the off-time portion of the cycle, the drive motor 22 is deactivated. Typical cycle times include an on-time portion of two (2) minutes and an off-time portion of five (5) seconds. As long as the fabric rope 14 is propelled through the treatment chamber 12 by the jet assembly 16, the lifter reel 18 will continue to rotate when deactivated due to movement of the fabric rope 14 thereon, causing the armature of the drive motor 22 to rotate.

As is conventional with a direct current machine, mechanical rotation of the armature will cause a voltage or EMF to be felt across the terminals thereof. It is this so-called "counter EMF" that is monitored by the voltage sensing relay 32 within the control circuit 40.

Figure 4:
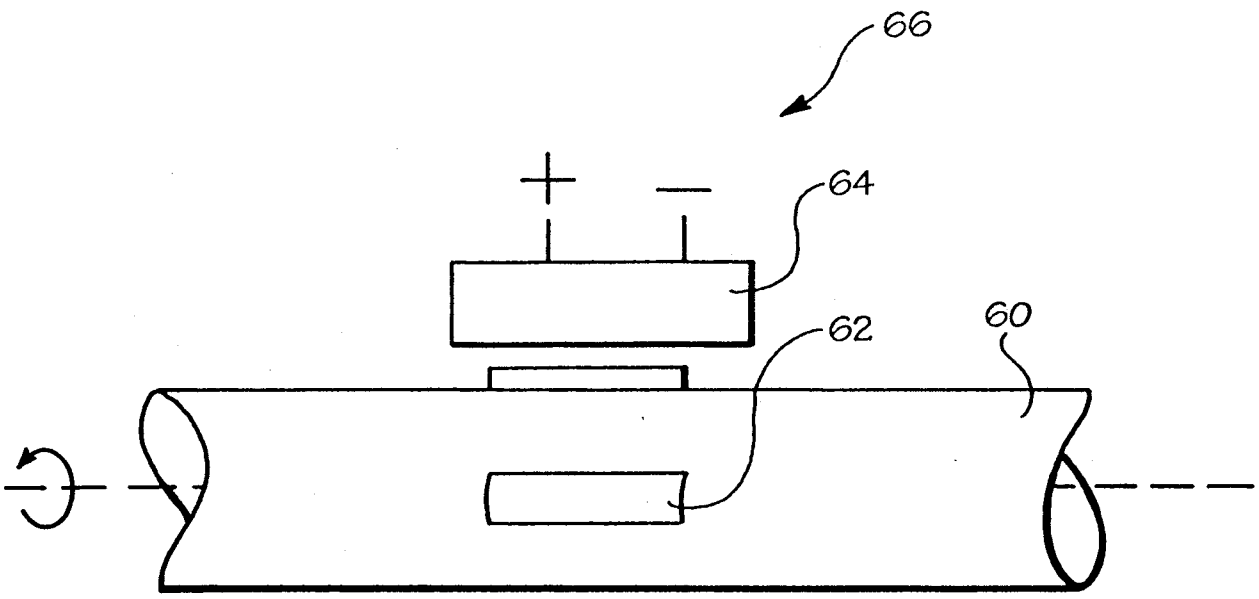
FIG. 4 is a schematic representation of an alternative apparatus for producing an electrical signal proportional to the rotational speed of the lifter reel.

An alternate approach to producing an electrical signal proportional to the rotational speed of the lifter reel drive motor is illustrated in FIG. 4. At least one permanent magnet 62 is associated with a rotational component of the lifter reel, preferably the armature 60 of the drive motor 22. A detector 64, which may be an induction coil, is positioned to be periodically adjacent a magnetic element 62 when the lifter reel drive motor armature 60 is rotating. As the magnetic element 62 passes adjacent the detector 64, it induces an electromotive force in the detector 64 which produces a voltage at the output 66 of the detector proportional to the rotational speed of the lifter reel 18. The resultant output voltage may be applied to the voltage sensing relay 32.

As to specific circuit operation, during the on-time portion of the cycle, the first timer relay contact 72 will be closed thereby applying control voltage to the contacts of the motor actuating relay 70, closing the normally open contacts thereof, thereby enabling the DC motor control 38 which starts and runs the lifter reel drive motor 22. The second timer contact 73 is open during the on-time portion of the cycle and the alarm relay 76 is de-energized. The control timer 43 will operate continuously due to the typical application wherein a common control timer 43 will operate with a plurality of lifter reels within a jet dyeing machine. When the circuitry senses a fabric disruption, the control timer 43 has no further effect on the problematic lifter reel while other lifter reels continue operation.

As the speed of the drive motor 22 increases, voltage across the armature rises above the threshold voltage setting of the voltage sensing relay (VSR) 32 causing the normally closed VSR contact 48 to open. The lifter reel drive motor 22 then continues to run for as long as the control timer 43 is in an on-time portion of its duty cycle.

When the off-time portion of the duty cycle occurs, the normally closed first timer contact 72 opens, deactivating the motor actuating relay 70 and thereby deactivating the motor control circuit 38, and thus deactivating the lifter reel drive motor 22. The normally open second timer contact 73 then closes and the ability of the circuit to sense disruptions in fabric flow is thereby initiated.

If, during the off-time portion of the cycle, the fluid jet assembly 16 is able to continue moving the fabric rope 14, the lifter reel 18 will continue to rotate, being propelled by the friction of the moving fabric rope 14 on the lifter reel 18. The speed of lifter reel rotation will be proportional to fabric speed. As previously stated and as is conventional with DC machines, a counter-EMF will be generated by the mechanically induced rotation of the direct current lifter reel drive motor 22. The value of the voltage or EMF will be proportional to the rotation rate of the lifter reel and thus fabric speed. If the generated EM is greater than the threshold setting of the VSR 32, the normally closed VSR contact 48 will remain open.

Should the jet nozzle assembly 16 be unable to propel the fabric rope 14 at a normal rate during the off-time portion of the cycle, the stopped, tangled, or otherwise obstructed strand will cause sufficient frictional delay of the supposedly free spinning lifter reel 18 to slow or stall the drive motor 22 causing the generated counter EMF to be correspondingly reduced in magnitude. Once the generated EMF is reduced below the threshold value of the VSR setting, the normally closed VSR contact 48 is closed. With both the second timer contact 73 and the VSR contact 48 closed, the alarm relay 76 is activated and the alarm light 74 is lighted. Optionally, an audible alarm (not shown) may also be activated. The motor control contacts 52 of the alarm relay 76 are then opened to halt further operation of the drive motor 22.

Within the alarm circuit 46, a normally open contact 50 of the alarm relay 76 and a normally closed reset switch 77 provide a holding circuit to latch the coil of the alarm relay 76 independently of the timer contacts 73 and the VSR contact 48 thereby disabling the drive motor 22, regardless of the status of the timer 43 or the VSR 32. This safety device insures that the alarm will remain activated and the lifter reel drive motor 22 will remain deactivated until the abnormal situation has been checked and corrected by an operator and the reset switch 77 is cycled. The opening of the reset switch 77 will deactivate the alarm relay 76 and operation will return to normal.

Typical jet-dyeing machines may have from one to six dyeing chambers with one lifter reel in each chamber. In the case of multiple reel operation, the circuit would be duplicated for each reel, with the exception that one control timer could be shared by all control circuits.

According to the method of the present invention, operation of the apparatus 10 is generally as follows. Disruptions in fabric flow are automatically detected, further fabric movement is halted and an alarm is activated to alert machine operators to the flow conditions within the jet dyeing machine. During a normal dyeing operation, a rope of fabric material 14 is circulated through the treatment chamber 12 of the jet dyeing machine 10. The fabric is propelled in a recirculating route through the treatment chamber 12 by action of the lifter reel 18 and the jet nozzle assembly 16. The control timer 43 cycles the drive motor 22 between a driving condition and a non-driving condition. During the driving condition, the lifter reel drive motor 22 assists propulsion of the fabric rope 14. During the non-driving condition, the direct current lifter reel drive motor 22 is caused to be driven by the fabric rope 14 being propelled by the jet nozzle assembly 16. As is conventional, an electromotive force will then be generated by the direct current lifter reel motor 22.

The voltage sensing relay 32 measures the DC output voltage, or counter EMF, of the lifter reel drive motor 22 and compares the measured value to a predetermined threshold value. A disrupted flow condition will cause the measured value of generated electromotive force to be less than the predetermined threshold value whereupon the electric circuitry will activate a alarm and lock the lifter reel drive motor 22 into a deactivated condition, which deactivates the lifter reel 18 preventing further fabric driving movement by the lifter reel 18. As will be appreciated by those skilled in the art, the alarm may be audible, visible or a combination of the two.

Once a dyeing machine operator investigates and hopefully remedies the disrupted flow condition, the reset switch 77 is cycled which returns the apparatus to a normal operating condition, allowing the lifter reel drive motor 22 to resume its driving condition.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for sensing disruptions in fabric flow in a machine for wet processing of fabric in endless rope form having jet means for applying liquid to the fabric rope, the application of liquid by the jet means causing circulation of the fabric rope through the machine and a driven lifter reel over which the fabric rope travels in advance of the jet means, said method comprising the steps of:

(a) circulating the fabric rope;

(b) driving said lifter reel;

(c) periodically interrupting the drive of said lifter reel;

(d) sensing said rotational speed of said lifter reel while drive thereof is interrupted;

(e) comparing said rotational speed to a predetermined threshold value;

(f) initiating a predetermined activity responsive to a detected value of said rotational speed which is less than said predetermined threshold value.

2. A method for sensing disruptions in fabric flow according to claim 1 wherein said step of sensing said rotational speed of said lifter reel includes generating an electromotive force proportional to said rotational speed of said lifter reel.

3. A method for sensing disruptions in fabric flow according to claim 2 wherein said step of comparing said rotational speed to a predetermined threshold value includes comparing said generated electromotive force to a predetermined threshold value of electromotive force.

4. A method for sensing disruptions in fabric flow according to claim 2 wherein said step of predetermined activity initiating is responsive to a predetermined threshold value of electromotive force less than s id generated electromotive force when the fabric rope is traveling at normal operating speed when driven by the jet means.

5. A method for sensing disruptions in fabric flow according to claim 1 and further comprising the step of resettably discontinuing drive of said lifter reel to prevent further driving movement of the fabric rope thereby upon initiation of said predetermined activity.

6. A method for sensing disruptions in fabric flow according to claim 5 wherein said steps of periodically discontinuing drive of said lifter reel and resettably discontinuing drive of said lifter reel result in said lifter reel becoming freely rotatable.

7. A method for sensing disruptions in fabric flow according to claim 1 wherein said step of predetermined activity initiating includes initiating the activation of an alarm.

8. An apparatus for sensing disruptions in fabric flow in an assembly for the wet processing of fabric in endless rope form having jet means for applying liquid to the fabric rope, the application of liquid by the jet means causing circulation of the fabric rope through the machine, and a driven lifter reel over which the fabric rope travels in advance of the jet means, said apparatus comprising:

(a) means for driving said lifter reel;

(b) means for periodically interrupting the drive of said lifter reel;

(c) means for sensing said rotational speed of said lifter reel;

(d) means for comparing said rotational speed to a predetermined threshold value;

(e) means for initiating a predetermined activity responsive to a value of said rotational speed which is less than said predetermined threshold value.

9. An apparatus for sensing disruptions in fabric flow according to claim 8 wherein said means for sensing said rotational speed of said lifter reel includes means for generating an electromotive force response to said rotational speed of said lifter reel.

10. An apparatus for detecting disruptions in fabric flow according to claim 9 wherein said means for comparing said rotational speed to said predetermined threshold value includes means for comparing said generated electromotive force to a predetermined threshold value of electromotive force.

11. An apparatus for sensing disruptions in fabric flow according to claim 10 wherein said initiating means initiates a predetermined activity responsive to a predetermined threshold value of electromotive force less than said electromotive force generated by said generating means when the fabric rope is traveling at normal operating speed when driven by said jet means.

12. An apparatus for sensing disruptions in fabric flow according to claim 10 wherein said means for driving said lifter reel has a driving condition wherein said driving means imparts a rotational force to said lifter reel, and a non-driving condition wherein said driving means imparts no rotational force to said lifter reel thereby allowing said lifter reel to rotate in response to said fabric rope movement and during said non-driving condition said means for sensing said rotational speed of said lifter reel produces an electrical signal responsive to said rotational speed of said lifter reel.

13. An apparatus for sensing disruptions in fabric flow according to claim 8 wherein said initiating means initiates the activation of an alarm.

14. An apparatus for sensing disruptions in fabric flow according to claim 8 wherein said means for driving said lifter reel has a driving condition wherein said driving means imparts a rotational force to said lifter reel, and a non-driving condition wherein said driving means imparts no rotational force to said lifter reel thereby allowing said lifter reel to rotate in response to said fabric rope movement and during said non-driving condition said driving means generates an electromotive force responsive to said rotational speed of said lifter reel.

15. An apparatus for sensing disruptions in fabric flow according to claim 8 and further comprising means for resettably discontinuing drive of said lifter reel to prevent further driving movement of the fabric rope thereby upon initiation of said predetermined activity.

16. An apparatus for sensing disruptions in fabric flow according to claim 8 wherein said lifter reel is freely rotatable upon discontinuing the driving thereof.

17. An apparatus for sensing disruptions in fabric flow according to claim 8 wherein said means for generating said electromotive force and said means for driving said lifter reel is a direct current machine.

18. An apparatus for sensing disruptions in fabric flow according to claim 17 wherein said direct current machine functions as a generator in response to said fabric rope movement on said lifter reel when said drive of said lifter reel is interrupted.

19. An apparatus for sensing disruptions in fabric flow according to claim 8 wherein said means for detecting said generated electromotive force, said means for comparing said electromotive force to said threshold value, said means for initiating said predetermined activity and said means for periodically disengaging said lifter reel from its power source are included in an electric circuit.

20. An apparatus for sensing disruptions in fabric flow according to claim 8 wherein said means for sensing said rotational speed of said lifter reel includes at least one magnetic element associated with said lifter reel for rotation therewith and detector means adjacent said lifter reel for sensing the passage of said at least one magnetic element thereby and generating an electrical signal in response thereto.

21. An apparatus for sensing disruptions in fabric flow according to claim 8 wherein said means for comparing said lifter reel rotational speed to said threshold value, said means for initiating said predetermined activity and said means for periodically interrupting the drive of said lifter reel are included in an electrical circuit.

* * * * *

UNITED STATES PATENT AND TRADEMARK OFFICE

CERTIFICATE OF CORRECTION

PATENT NO. : 5,239,719

DATED : August 31, 1993

INVENTOR(S) : Melvin L. Ware

It is certified that error appears in the above-identified patent and that said Letters Patent is hereby corrected as shown below:

Column 3, line 52, delete "n" and insert therefor -- no --.

Column 4, line 9, delete "a" and insert therefor -- an --.

Column 5, line 45, after "value" insert -- , --.

Column 7, line 29, delete "EM" and insert therefor -- EMF --.

Column 8, line 25, delete "a" and insert therefor -- an --.

Column 8, line 63, after "machine" insert -- , --.

Column 9, line 24, delete "s id" and insert therefor -- said --.

Signed and Sealed this

Twenty-sixth Day of July, 1994

*Attest:*

Bruce Lehman

BRUCE LEHMAN

*Attesting Officer*

*Commissioner of Patents and Trademarks*